US009671169B2

(12) United States Patent
Riondet et al.

(10) Patent No.: US 9,671,169 B2
(45) Date of Patent: Jun. 6, 2017

(54) COOLING RADIATOR FOR A VEHICLE, PARTICULARLY A MOTOR VEHICLE

(71) Applicant: Valeo Systemes Thermiques, Le Mesnil Saint Denis (FR)

(72) Inventors: Christian Riondet, Bourgogne (FR); Alan Day, Reims (FR)

(73) Assignee: VALEO SYSTEMES THERMIQUES, Le Mesnil Saint Denis (FR)

( * ) Notice: Subject to any disclaimer, the term of this patent is extended or adjusted under 35 U.S.C. 154(b) by 191 days.

(21) Appl. No.: 14/375,846

(22) PCT Filed: Feb. 1, 2013

(86) PCT No.: PCT/EP2013/052084
§ 371 (c)(1),
(2) Date: Jul. 31, 2014

(87) PCT Pub. No.: WO2013/113900
PCT Pub. Date: Aug. 8, 2013

(65) Prior Publication Data

US 2015/0041106 A1 Feb. 12, 2015

(30) Foreign Application Priority Data

Feb. 3, 2012 (FR) ..... 12 51015

(51) Int. Cl.
*F28D 1/053* (2006.01)
*F28D 1/03* (2006.01)
(Continued)

(52) U.S. Cl.
CPC ..... *F28D 1/05358* (2013.01); *F28D 1/0391* (2013.01); *F28F 1/06* (2013.01);
(Continued)

(58) Field of Classification Search
CPC ..... F28F 2001/027; F28F 1/06; F28F 1/08; F28F 1/16; F28F 1/022; F28D 1/05358; F28D 1/0391; F28D 2021/0094
(Continued)

(56) References Cited

U.S. PATENT DOCUMENTS 4,470,452 A * 9/1984 Rhodes ..... F28D 1/0391 165/153
5,730,213 A * 3/1998 Kiser ..... F28D 1/05383 165/109.1
(Continued)

FOREIGN PATENT DOCUMENTS

EP 0 710 811 A2 5/1996

OTHER PUBLICATIONS

International Search Report for Application No. PCT/EP2013/052084 dated May 17, 2013, 5 pages.

*Primary Examiner* — Tho V Duong
(74) *Attorney, Agent, or Firm* — Howard & Howard Attorneys PLLC

(57) ABSTRACT

The invention relates to a cooling radiator for a vehicle, in particular a motor vehicle, comprising a bundle allowing the exchange of heat between a first fluid and a second fluid. The bundle includes at least one row of parallel tubes (2) through which the first fluid flows, said tubes being flat and spaced apart from one another by a pitch, known as the tube pitch, in a first direction. In addition, the tubes (2) are provided with corrugations (22) designed to disrupt the flow of the first fluid. The tube pitch is between 5 and 8 mm.

12 Claims, 3 Drawing Sheets

(51) Int. Cl.
*F28F 1/06* (2006.01)
*F28D 21/00* (2006.01)
*F28F 1/02* (2006.01)

(52) U.S. Cl.
CPC ..... *F28D 2021/0094* (2013.01); *F28F 1/022* (2013.01); *F28F 2001/027* (2013.01)

(58) Field of Classification Search
USPC ..... 165/179, 109.1
See application file for complete search history.

(56) References Cited

U.S. PATENT DOCUMENTS

| | | | | |
|---|---|---|---|---|
| 6,935,418 | B1 * | 8/2005 | Valaszkai | F28F 1/022 165/109.1 |
| 7,073,570 | B2 * | 7/2006 | Yu | F28D 1/0443 165/140 |
| 2002/0153131 | A1 | 10/2002 | Sugawara et al. | |
| 2005/0045314 | A1 | 3/2005 | Elbourini | |
| 2009/0314475 | A1 * | 12/2009 | Jeon | F28D 1/0391 165/109.1 |
| 2012/0024510 | A1 | 2/2012 | Kohl et al. | |

* cited by examiner

COOLING RADIATOR FOR A VEHICLE, PARTICULARLY A MOTOR VEHICLE

RELATED APPLICATIONS

This application is the National Stage of International Patent Application No. PCT/EP2013/052084, filed on Feb. 1, 2013, which claims priority to and all the advantages of French Patent Application No. 12/51015, filed on Feb. 3, 2012, the content of which is incorporated herein by reference.

The invention relates to a cooling radiator for a vehicle, particularly a motor vehicle. It can in particular relate to cooling radiators for the vehicle engine.

There are known cooling radiators comprising a bundle of parallel tubes and two collectors (or collecting boxes) in which the corresponding ends of the tubes are connected in a fixed and fluid-tight manner. A cooling fluid can therefore circulate through the tubes and exchange heat with a flow of external air passing between the tubes. For this, the radiators are placed on the front face of the vehicle and the air flow reaches the radiator by passing through the grille.

Numerous solutions have already been proposed for increasing the thermal performance of such exchangers. In particular it is known that their tubes can be provided with corrugations allowing the flow of fluid to be disrupted. Indeed, having a turbulent flow improves heat exchange.

However, such a solution increases the pressure drops generated by the exchanger. It therefore results in oversizing the pumps to be used for circulating the fluid in the cooling system of the engine.

In parallel, there has already been a proposal for heat exchangers having a relatively small tube pitch, i.e. spacing between the tubes. It should be noted that such a feature also has the drawback of generating pressure drops, this time in the air.

There is thus a need for a cooling radiator having improved thermal performance while controlling the pressure drops generated in the fluid(s) exchanging heat via the radiator.

To this end, the invention proposes a cooling radiator for a vehicle, in particular a motor vehicle, comprising a bundle allowing the exchange of heat between a first fluid and a second fluid, said bundle comprising at least one row of parallel tubes through which the first fluid flows, said tubes being designed to be flat and spaced apart from one another by a pitch, known as the tube pitch, in a first direction, said tubes being provided with corrugations configured so as to disrupt the flow of said first fluid and said tube pitch being between 5 and 8 mm, particularly between 5.5 and 7.5 mm, even more particularly between 6 and 7 mm.

The term "flat tube" means a tube comprising two parallel, plane major faces connected by lateral or radiused sides, the total height of the tube, that is, its dimension in the direction perpendicular to the plane major faces, being less than the total width of the tube, i.e. its dimension in the direction perpendicular to the total height of the tube and to the longitudinal axis of the tube.

One particularly advantageous embodiment of the invention relies on the link made by the applicant between the operating characteristics of the pumps used in cooling loops and characteristics of the radiator that will allow the operation thereof to be optimised.

In this respect, FIG. 1 illustrates the overall efficiency "e" of a pump as a function of the flow rate "D" of fluid that it generates. It can be seen that efficiency initially increases up to a certain flow rate before decreasing. In other words, there is a flow rate value at which the efficiency of the pump is at its maximum, here around 4000 liters per hour.

FIG. 2 illustrates the pressure "P" of the fluid leaving the pump as a function of the flow rate "D" that it generates. It can be seen that pressure falls with flow rate.

With a view to optimising the overall energy efficiency of the vehicle, it is advantageous to get the pump to operate in its zone of maximum efficiency. By transferring this value to the curve in FIG. 2, the corresponding pressure at the pump outlet can then be identified, which makes it possible to determine an optimal overall pressure drop for the cooling system.

Since the pressure drop resulting from the other components of the circuit, such as the engine or the circulation passages between the engine and the cooling radiator, is known or specified, the corresponding pressure drop for the radiator can be evaluated.

This being so, the applicant has discovered that a parameter particularly influencing the pressure drop generated by a radiator as defined above is the profile of the tube and, even more specifically, the internal height $h_T$ of the tube. The term "internal height" means the distance between the inner walls of the plane faces of the tube, or the height of the circulating layer of fluid in the tube, such a distance being measured at a portion of the walls that has no corrugations.

The curves 3 and 4 thus illustrate the relationships between this parameter and, respectively, the pressure leaving the pump and the overall efficiency of said pump.

The invention therefore proposes a radiator wherein the tubes have an internal height of between 0.6 and 1.5 mm, more particularly between 0.8 and 1.2 mm. Indeed, it can be noted in FIG. 4 that the pump functions optimally in this range of values.

According to other features of the invention, which may be taken together or separately:

- a thickness of the material of the tubes is less than or equal to 270 μm particularly 230 μm, even more particularly 200 μm,
- the corrugations are configured so as to represent 10 to 50% of the cross section of the tubes,
- the corrugations are configured so as to represent less than 10% of the internal volume of the tubes,
- the tubes have a width between 10 and 45 mm,
- the tubes have:
  - either a width less than 24 mm and an internal height greater than or equal to 1 mm,
  - or a width greater than 24 mm and an internal height less than 1 mm,
- the corrugations are created from the material of a wall of the tubes,
- the corrugations have a free end,
- said tubes are formed by bending a sheet of material.

The accompanying figures will make it easier to understand how the invention can be implemented. In these figures, identical reference numerals denote similar elements.

FIG. 1, mentioned previously, illustrates the overall efficiency of a pump as a function of the fluid flow generated thereby.

FIG. 2, mentioned previously, illustrates the pressure of the fluid leaving the pump of FIG. 1 as a function of the fluid flow generated thereby.

FIG. 3, mentioned previously, takes FIG. 2 and combines it with the internal height of a tube of a cooling radiator.

FIG. 4, mentioned previously, takes FIG. 1 and combines it with the same featureas that used in FIG. 3.

Figure 1:
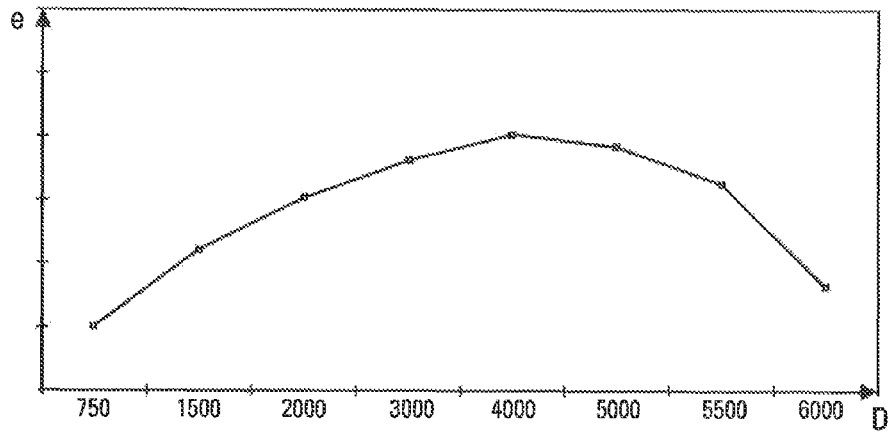
Figure 2:
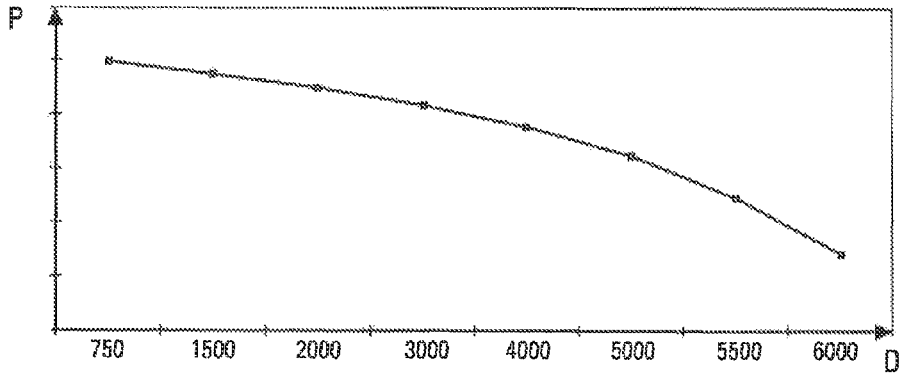
Figure 3:
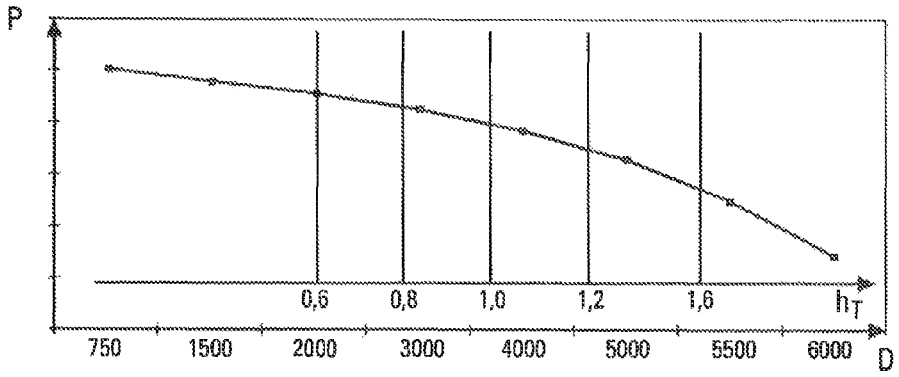
Figure 4:
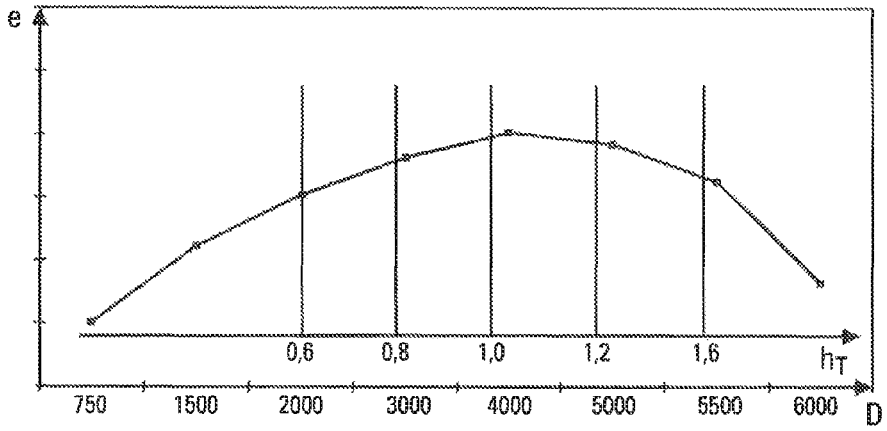
Figure 5:
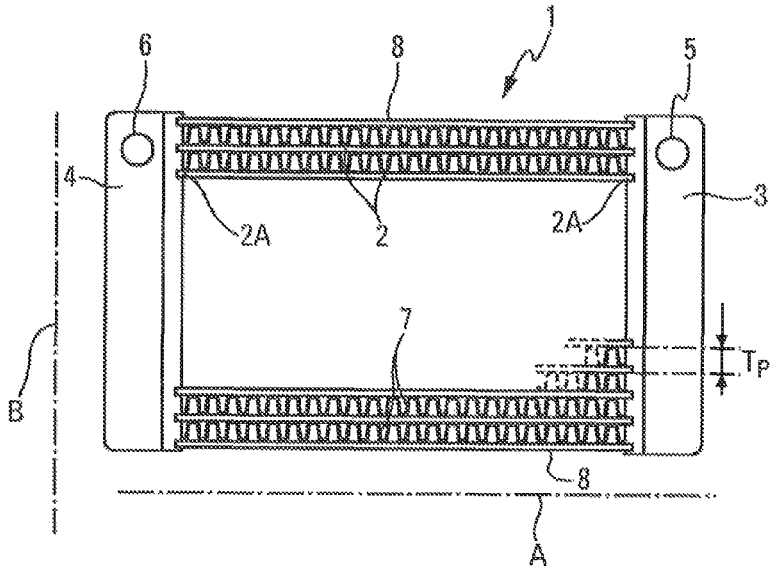
FIG. 5 is an overall view of a cooling radiator according to the invention.

As illustrated in FIG. 5, the invention relates to a cooling radiator 1 for a vehicle, particularly a motor vehicle, comprising a bundle allowing heat to be exchanged between a first and a second fluid. The first fluid is constituted, for example, by a cooling fluid such as a mixture of water and glycol. The second fluid is constituted, for example, by air.

Said radiator can be configured so as to be placed on the front face of a motor vehicle in order to be swept by a flow of ambient air passing through a grille of the vehicle.

Said bundle comprises a row of tubes 2, parallel to oneanother, through which the first fluid can flow. Said tubes 2 extend in a longitudinal direction marked A in the figure. Each tube 2 here has two longitudinal ends 2A connected, in a fixed and fluid-tight manner, to collecting boxes 3, 4 of the radiator so that said first fluid can circulate through said radiator.

Said collecting boxes 3, 4 comprise, for example, a collecting plate and a cover defining an internal volume of the box. The tubes 2, particularly the longitudinal ends 2A of the tubes 2, open out into said internal volume through orifices provided in the collecting plates. Attachment brackets, not illustrated, can be added to these collecting boxes 3, 4. Said collecting boxes can also comprise, respectively, inlet 5 and outlet 6 tubing.

The collecting plates of said collecting boxes 3, 4 are, for example, made of metal, particularly aluminium or aluminium alloys. The covers are, for example, made of plastics and are crimped onto the collecting plates. As a variant, the collecting plates and the covers are both made of metal, particularly aluminium or aluminium alloys.

Spacers 7 can be arranged between the tubes 2, to increase the surface area of thermal exchange between the fluid circulating in the tubes 2 and the air circulating between said tubes 2. The tubes 2 and the spacers 7 are here stacked alternately in the direction B, perpendicular to the axis A in the plane of the figure.

The radiator can also comprise lateral cheeks 8 protecting the bundle on either side of the stack of tubes 2 and spacers 7.

Figure 6:
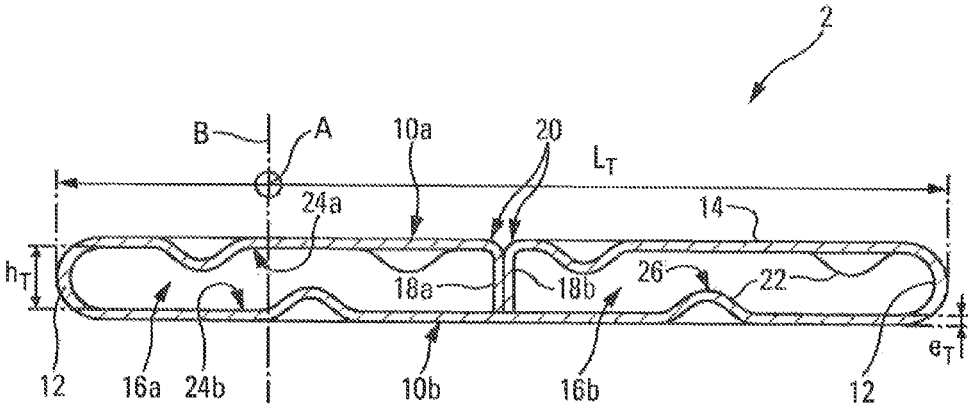
FIG. 6 is a view in cross section of a tube of the exchanger of FIG. 5.

As illustrated in FIG. 6, said tubes 2 are designed to be flat. As already stated, this means that the tubes 2 comprise two parallel, plane major faces 10*a*, 10*b*, connected by lateral or radiused sides 12. This means that the height of the tubes 2, that is, their dimension in the direction perpendicular to the plane faces 10*a*, 10*b*, which corresponds to the direction B of stacking of the tubes 2 and spacers 7, is less than the width $L_T$ of said tubes 2, i.e. their dimension in the direction perpendicular to the direction B and the longitudinal axis A of the tubes 2, said longitudinal axis being orthogonal to the plane of the figure.

The tubes 2 are, for example, of the type comprising a metal strip 14, folded over on itself so as to define several fluid circulation channels 16*a*, 16*b*.

Said tubes 2 can in particular have a configuration in which said metal strip 14 has legs 18*a*, 18*b* joining a first plane face 10*a* of the tube to the second plane face 10*b*, so as to define said channels 16*a*, 16*b*. This means that the free ends of said legs 18*a*, 18*b* are in contact with said second plane face 10*b*.

As can be seen more easily in FIG. 6, said legs 18*a*, 18*b* have, for example, a base formed of an elbowed portion 20 of the metal strip 14 connecting them to the first plane face 10*a*. They extend here, one against the other, so as to finish against the second plane face 10*b*, particularly via their sheared end. Here, they define two channels 16*a*, 16*b* substantially equal in cross section. In other words, said legs 18*a*, 18*b* are positioned along a median plane of the tubes 2. Said tubes thus substantially have a profile that is substantially B-shaped.

Such tubes 2 are made fluid-tight, for example, by brazing, the brazing of the tubes 2 of the same exchanger being done, in particular, simultaneously with the brazing of all the metal portions of the exchanger. With regard to this, said sheet of material 14 is, for example, made of aluminium or aluminium alloy.

This being the case, according to the invention, said tubes 2 are provided with corrugations 22 configured so as to disrupt the flow of said first fluid. The term corrugations 22 means shapes having a profile projecting into the channel(s) 16*a*, 16*b* defined by said tubes 2. In FIG. 6, some of said corrugations 22 are in the cross sectional plane while others are located behind it.

The corrugations 22 can be created from the material of a wall of the tube, i.e., here, from the metal strip 14. They are formed, for example, by deep-drawing said metal strip 14. They are located, in particular, on the plane faces 10*a*, 10*b* of the tubes. Said corrugations 22 have, for example, a free end (26). This means that they are in contact neither with the opposite plane face 10*a*, 10*b* nor with another of said corrugations 22.

For each tube, said corrugations 22 are configured, for example, so as to represent 10 to 50% of the cross section of the tube. In other words, where:

Sfd is the frontal cross section of the corrugations, i.e. the surface area of the portion of the section of the circulation channel(s) 16*a*, 16*b* of the tube obstructed by the corrugations 22, Stl is the internal cross section of the smooth tube (Stl), i.e. the cross section that the tube would have without its corrugations 22, the ratio Sfd/Stl is in the range of 10 to 50%, preferably 10 to 40%, and more preferably 20 to 40%. Such a relationship is true, for example, along the whole length of the tube or, at least, for all cross sections of the tube taken through one or more corrugations.

For each tube, said corrugations 22 can also be configured so as to represent less than 10% of the internal volume of the tube. In other words, where:

Vtd is the total volume of the corrugations 22 inside the tube,

Vtl is the total internal volume of the tube, the ratio Vtd/Vtl is less than 0.1, preferably less than 0.05.

Still according to the invention, said tubes 2 are furthermore spaced apart from oneanother in the direction B by a pitch Tp (visible in FIG. 5), known as tube pitch, of between 5 and 8 mm. Said tube pitch can more particularly be between 5.5 and 7.5 mm, and even more particularly between 6 and 7 mm.

Using tubes 2 provided with such corrugations 22 and having such a tube pitch already optimises the performance of the radiator.

To improve this result even further, tubes 2 can also be chosen with an internal height $h_T$ of between 0.6 and 1.5 mm, more particularly between 0.8 and 1.2 mm.

The term "internal height", as already stated, means the distance between the inner walls 24*a*, 24*b* of the plane faces 10*a*, 10*b* of the tubes 2 or else the height of the circulating layer of the first fluid in said tubes 2, such a distance being measured at a portion of the walls with no corrugations 22.

Said tubes 2 can have a thickness $e_T$ of the material of less than 270 μm, more particularly 230 μm, even more particularly 200 μm.

Different bundle widths can be used. The tubes 2 thus have, for example, a width $L_T$ between 10 and 40 mm, particularly between 14 and 34 mm. More particularly, the tubes 2 can have:

either a width $L_T$ less than 24 mm and an internal height $e_T$ greater than 1 mm, or a width $L_T$ greater than 24 mm and an internal height $e_T$ less than 1 mm.

It should be noted that said corrugations 22 can have all possible distributions or shapes on the surface of the tube 2. Thus they can, for example, be arranged in rows or staggered on the same plane face 10*a*, 10*b* and/or from one plane face 10*a*, 10*b* to the next. They can also be circular or have elongated crosssections, forming the same angle or different angles to the longitudinal axis A of the tubes.

The invention claimed is:

1. A cooling radiator for a vehicle, the cooling radiator comprising a bundle allowing an exchange of heat between a first fluid and a second fluid, with the bundle comprising at least one row of parallel tubes (2) through which the first fluid flows, with the tubes (2) being designed to be flat and spaced apart from one another by a tube pitch Tp, in a first direction, and with the tubes (2) being provided with corrugations (22) configured so as to disrupt a flow of the first fluid and the tube pitch being between 5 and 8 mm, wherein the corrugations (22) are configured so as to represent 20 to 40% of a cross section of the tubes (2) and wherein the corrugations (22) are also configured so as to represent less than 10% of an internal volume of the tubes (2).

2. The radiator according to claim 1 wherein the tubes (2) have an internal height of between 0.6 and 1.5 mm.

3. The radiator according to claim 1 wherein the tubes (2) have a width $L_T$ of between 10 and 45 mm.

4. The radiator according to claim 1 wherein the tubes (2) have a width $L_T$ less than 24 mm and an internal height $h_T$ greater than or equal to 1 mm.

5. The radiator according to claim 1 wherein the corrugations (22) are created from material of a wall of the tubes (2).

6. The radiator according to claim 1 wherein the corrugations (22) have a free end (26).

7. The radiator according to claim 1 wherein the tubes (2) are formed by bending a sheet of material (14).

8. The radiator according to claim 1 wherein a thickness $e_T$ of a material of the tubes (2) is less than or equal to 270 μm.

9. The radiator according to claim 2 wherein the tubes (2) have a width $L_T$ of between 10 and 45 mm.

10. The radiator according to claim 9 wherein a thickness $e_T$ of a material of the tubes (2) is less than or equal to 270 μm.

11. The radiator according to claim 2 wherein a thickness $e_T$ of a material of the tubes (2) is less than or equal to 270 μm.

12. The radiator according to claim 1, wherein the tubes (2) have a width $L_T$ greater than 24 mm and an internal height $h_T$ less than 1 mm.

* * * * *